US005620820A

United States Patent [19]

Bertrand et al.

[11] Patent Number: 5,620,820

[45] Date of Patent: Apr. 15, 1997

[54] FOUR COLOR TONER SET

[75] Inventors: Jacques C. Bertrand, Ontario; Roger N. Ciccarelli, Rochester; Thomas R. Pickering, Webster; Denise R. Bayley, Fairport, all of N.Y.

[73] Assignee: Xerox Corporation, Stamford, Conn.

[21] Appl. No.: 542,371

[22] Filed: Oct. 12, 1995

[51] Int. Cl.[6] ..... G03G 9/09

[52] U.S. Cl. ..... 430/42; 430/45; 430/106; 399/223

[58] Field of Search ..... 430/45, 106, 111, 430/42

[56] References Cited

U.S. PATENT DOCUMENTS

| | | | |
|---|---|---|---|
| 3,590,000 | 6/1971 | Palermiti et al. | 252/62.1 |
| 4,338,390 | 7/1982 | Lu | 430/106 |
| 5,114,821 | 5/1992 | Haack | 430/110 |
| 5,262,264 | 11/1993 | Shimizu et al. | 430/106 |
| 5,300,383 | 4/1994 | Tsubota et al. | 430/45 |
| 5,415,963 | 5/1995 | Toya et al. | 430/106 |

*Primary Examiner*—John Goodrow
*Attorney, Agent, or Firm*—E. O. Palazzo

[57] ABSTRACT

Toners comprised of a mixture of a cyan toner, a magenta toner, a yellow toner, and a black toner each of said toners being comprised of resin and pigment, and wherein the pigment for the cyan toner is a β type copper phthalocyanine, the pigment for the magenta toner is a xanthene silicomolybdic acid salt of Rhodamine 6G dye, the pigment for the yellow toner is an isoindoline, and the pigment for the black toner is carbon black.

29 Claims, No Drawings

FOUR COLOR TONER SET

BACKGROUND OF THE INVENTION

The present inventions are generally directed to toner and developer compositions, and more specifically, the present invention is directed to developer and toner compositions with certain pigments, or mixtures thereof, and wherein full color developed images with excellent resolution can be obtained. In embodiments, the toners of the present invention contain flushed pigments, and wherein there is selected a wet pigment, or wet cake for each colored toner followed by heating to melt the resin or render it molten and shearing, and wherein water is removed from the pigment and there is generated in embodiments a polymer phase around the pigment enabling, for example, substantial, partial passivation of the pigment. A solvent can be added to the product obtained to provide a high quality dispersion of pigment and resin, and wherein the pigment is present in an amount of from about 2 to 50, and preferably from about 30 to about 40 weight percent. Subsequently, the product obtained is mixed with a toner resin, which resin can be similar, or dissimilar than the resin mixed with the wet pigment, to provide a toner comprised of resin and pigment, and wherein in embodiments the pigment is present in an amount of from about 2 to about 25, and preferably from about 2 to about 15 weight percent based on the weight of the toner components of resin and pigment. In embodiments, there is formed one toner with four different pigments, or four toners with different pigments. There is provided in accordance with the present invention four colored toners with the colored pigment dispersed to a high quality state. With the present invention, there is enabled a combination of toners with a high color gamut, especially in reflection developed images and with transparencies, and wherein with transparencies a substantial amount of scattered light, and embodiments most of the scattered light is eliminated allowing, for example, about 70 to about 98 percent of the transmitted light passing through a fused image on a transparency to reach the screen from an overhead projector. The toner and developer compositions of the present invention can be selected for electrophotographic, especially known xerographic imaging and printing processes, and more, especially full color processes.

Of importance with respect to the present invention in embodiments are the pigments, or mixtures of pigments selected for each toner, and the combination set, or gamut of toners, such as the cyan toner, the magenta toner, the yellow toner, and the black toner, as it is with these pigments that there is enabled the advantages of the present invention illustrated herein and including excellent stable triboelectric characteristics, acceptable stable admix properties, superior color resolution, the capability of obtaining any colors desired, that is a full color gamut, for example thousands of different colors and different developed color images, substantial toner insensitivity to relative humidity, toners that are not substantially adversely affected by environmental changes of temperature, humidity, and the like, the provision of separate toners, such as black, cyan, magenta, and yellow toners, and mixtures thereof with the advantages illustrated herein, and which toners can be selected for the multicolor development of electrostatic images. The specific selection of colored toners together with having the pigments exceptionally well and substantially dispersed, and the image fused so that the image surface is smooth enables a large color gamut which assures that thousands of colors can be produced. The toner compositions of the present invention usually contain surface additives and may also contain charge additives and waxes, such as polypropylene.

Combination or set refers, in embodiments of the present invention, to separate toners that are not mixed together, rather each toner exists as a separate composition and each toner is incorporated into separate housings containing carrier in a xerographic machine, such as the Xerox Corporation 5775. For example, the cyan toner is present in one developer housing, the magenta toner is present in a second separate developer housing, the yellow toner is present in a third separate developer housing, and the black toner is present in a fourth separate developer housing; and wherein each developer housing includes therein carrier particles such as those particles comprised of a core with a coating thereover.

Certain toner and developer compositions are known, including toners with specific pigments, such as magenta pigments like 2,9-dimethyl-substituted quinacridone and anthraquinone dye identified in the Color Index as CI 60710, CI Dispersed Red 15, diazo dye identified in the Color Index as CI 26050, CI Solvent Red 19; cyan pigments such as copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137; yellow pigments such as diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL; and black pigments such as REGAL 330® carbon black. Moreover, toners with certain colored pigments are illustrated in U.S. Pat. No. 5,262,264, the disclosure of which is totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Further, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Moreover, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, of interest are U.S. Pat. Nos. 5,262,264 and 5,437,949, the disclosures of which are totally incorporated herein by reference.

COPENDING APPLICATIONS

In copending patent applications and patents U.S. Ser. No. 451,379, U.S. Statutory Invention Registration No. H1577, U.S. Ser. No. 452,241, U.S. Pat. No. 5,536,608, and U.S Ser. No. 529,261, now U.S. Pat. No. 5,561,013, the disclosures of which are totally incorporated herein by reference, there are illustrated certain highlight color toners and processes thereof. More specifically, in U.S. Pat. No. 5,536,608 there is illustrated an imaging process which comprises (1) charging an imaging member in an imaging apparatus; (2) creating on the member a latent image comprising areas of high, intermediate, and low potential; (3) developing the low areas of potential with a first developer comprising carrier, and a first negatively charged toner comprised of resin, the cyan pigment Pigment Blue 15:3, Color Index number 74160:3, CAS Number 147-14-8, a mixture of charge enhancing additives, and surface additives; (4) developing the high areas of potential with a second developer comprising carrier and a second black toner comprised of resin, pigment, and a charge enhancing additive that enables a positively charged toner; (5) transferring the resulting developed image to a substrate; and (6) fixing the image thereto; and in U.S. Ser. No. 529,261 there is illustrated an imaging process which comprises (1) charging an imaging member in an imaging apparatus; (2) creating on the member a latent image comprising areas of high, intermediate, and low potential; (3) developing the low areas of potential with a first developer comprising carrier particles and a first negatively charged toner comprised of resin, the magenta pigment 2,9-dimethyl quinacridone, a charge additive, or a mixture of charge additives, and surface additives; (4) developing the high areas of potential with a second developer comprising carrier particles and a second black toner comprised of resin, pigment, and a charge enhancing additive that enables a positively charged toner; (5) transferring the resulting developed image to a substrate; and (6) fixing the image thereto.

Moreover, reference is made to the following copending applications, the disclosures, including the claims, of each being totally incorporated herein by reference, U.S. Ser. No. 542,373 now U.S. Pat. No. 5,556,727, U.S. Ser. No. 542,232 now U.S. Pat. No. 5,591,552, U.S. Pat. No. 5,654,471, U.S. Ser. No. 542,079, and U.S. Ser. No. 542,265, and all filed concurrently herewith.

SUMMARY OF THE INVENTION

Examples of objects of the present inventions illustrated herein include in embodiments:

It is an object of the present inventions to provide toner and developer compositions with many of the advantages illustrated herein.

In another object of the present inventions there are provided colored toner compositions with certain pigments, and which toners can be selected for the development of electrostatic latent images and the generation of full color developed images.

In yet another object of the present inventions there are provided colored toners wherein an extensive gamut of different colors, or different color shades are enabled.

Further, in another object of the present inventions there are provided toners enabling an entire range, or an entire series of colors, such as reds, blues, greens, browns, yellows, pinks, violets, mixtures thereof of colors, and the like, and variations thereof like from light red to dark red and the reds therebetween, from light green to dark green and the greens therebetween, from light brown to dark brown and the browns therebetween, from light yellow to dark yellow and the yellows therebetween, from light violet to dark violet and the violets therebetween, from light pink to dark pink and the pinks therebetween, and the like.

Moreover, in another object of the inventions there are provided toners with excellent high intensity color resolutions, and which toners possess high light transmission allowing about 70 to about 98 percent of the transmitted light passing through a fused image on a transparency to reach the screen from an overhead projector.

Also, in further objects of the inventions there are provided toners prepared with flushed wet pigments.

Additionally, in other objects of the inventions there are provided processes for the preparation of toners with flushed wetted pigments, followed by dilution with toner resin, and wherein the pigments are passivated in embodiments.

Another object of the inventions is the provision of toners with excellent triboelectric characteristics, acceptable admix values of, for example, from about 15 to about 60 seconds, high or low gloss characteristics, for example a gloss of from about 40 to about 70 Gardner Gloss units with certain resins, such as polyesters, especially linear polyesters, such as the SPAR polyesters, such as those illustrated in U.S. Pat. No. 3,590,000, the disclosure of which is totally incorporated herein by reference; extruded polyesters with a gel content of from about 1 to about 40, and preferably from about 1 to about 10 percent, which polyesters are illustrated, for example, in U.S. Pat. Nos. 5,376,494 and 5,227,460, the disclosures of which are totally incorporated herein by reference.

In objects of the present inventions there are provided toners that are substantially insensitive to relative humidities at various temperatures, for example from 25° to about 95° C.

Also, in another object of the inventions illustrated herein there are provided developer compositions with toner particles, and carrier particles.

In a further object of the present inventions there are provided humidity insensitive, from about, for example, 20 to 80 percent relative humidity at temperatures of from 60° to 80° F. as determined in a relative humidity testing chamber, positively or negatively charged colored toner compositions with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Another object of the present inventions resides in the formation of toners which will enable the development of images in electrophotographic imaging and printing apparatuses, including digital, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

Moreover, in another object of the present inventions there are provided a combination of toners, and which combination can be incorporated into an imaging apparatus, such as the Xerox Corporation 5775 and 5760 full process color machines, and wherein, for example, each of four toners can be selected to develop and provide images of a variety of colors, and more specifically, any color that is present on the original being copied, and wherein the image copied is substantially the same as the original image in color, color resolution, and color intensity.

These and other objects of the present inventions can be accomplished in embodiments thereof by providing toner compositions comprised of resin particles, pigment particles, and which toners can contain charge enhancing additives, waxes, and surface additives of, for example, silicas, metal oxides, metal salts of fatty acids, mixtures thereof, and the like.

Embodiments of the present inventions include a toner, preferably a toner combination comprised of a cyan toner, a magenta toner, a yellow toner, and an optional black toner, each of said toners being comprised of resin and pigment, and wherein the pigment for the cyan toner is a β or beta type copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; a combination of four color toners for the development of electrostatic latent images enabling the formation of a full color gamut image and wherein the four toners are comprised of a cyan toner, a magenta toner, a yellow toner, and a black toner, respectively, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; wherein said cyan pigment is Pigment Blue 15:3 having a Color Index Constitution Number of 74160, said magenta pigment is Pigment Red 81:3 having a Color Index Constitution Number of 45160:3, said yellow pigment is pigment Yellow 17 having a Color Index Constitution Number of 21105; and wherein said blue, said magenta and said yellow pigments are represented by the following formulas

C.I. 74160: PIGMENT BLUE 15:3

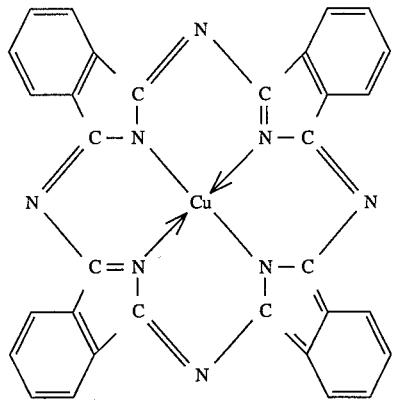

C.I. 45160:3:PIGMENT RED 81:3

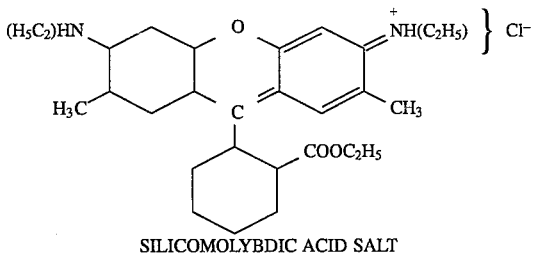

SILICOMOLYBDIC ACID SALT

C.I. 21105:PIGMENT YELLOW 17

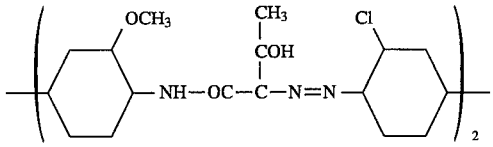

wherein each of said pigments are present in an amount of from about 2 to about 25 weight percent based on the weight percent of resin and pigment; wherein each of said pigments are present in an amount of from about 2 to about 15 weight percent based on the weight percent of resin and pigment; wherein each of said cyan, magenta, and yellow pigments possesses a diameter particle size or agglomerate diameter size of from about 0.01 micron to about 3 microns; wherein each of said cyan, magenta, and yellow pigments is of a particle diameter size or agglomerate diameter size of from about 0.01 micron to about 0.3 micron and the black pigment is of a particle diameter size of from about 0.001 micron to about 0.1 micron; wherein each of said cyan, magenta, and yellow pigments has a particle diameter size or agglomerate diameter size of from about 0.01 micron to about 0.3 micron, and said pigments are dispersed into said toner resin uniformly to thereby minimize light scattering and increase color gamut in reflection copy and overhead transparency copy; wherein each of said cyan, magenta, and yellow pigments is dispersed by flushing said cyan, magenta, or yellow pigments into said toner resin, and wherein a cyan, magenta, or yellow pigment water wet cake is mixed with toner resin and the water is removed to generate pigmented resin containing from about 2 to about 50 weight percent of pigment based on the weight percent of said toner resin and said pigment; wherein each of said cyan, magenta, and yellow pigments is dispersed by flushing said cyan, magenta, or yellow pigments into said toner resin, and wherein a cyan, magenta, or yellow pigment water wet cake is mixed with toner resin and the water is removed to generate pigmented resin containing from about 30 to about 40 weight percent pigment by weight, and wherein each of the resulting pigmented resin concentrate product is mixed and diluted with additional toner resin to generate cyan, magenta, and yellow toners containing each of said cyan, magenta, or yellow pigment, respectively, in an amount from about 2 to about 15 weight percent; wherein the fused image obtained with said combined, set, or gamut of toners has a Gardner Gloss value of from about 10 to 80 gloss units; a combination set, or gamut of four color toners each for the development of electrostatic latent images enabling the formation of a full color gamut image, and wherein the four toners are comprised of a cyan toner, a magenta toner, a yellow toner, and a black toner each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; a combination of toners wherein the fused image obtained with said toner combination has a Gardner Gloss value of from about 40 to 70 gloss units, wherein from about 70 to about 98 percent of the transmitted light passing through said fused image contained on a transparency reaches a projection screen from an overhead projector, wherein each of said cyan, magenta, and yellow pigments have a particle diameter size or agglomerate diameter size of from about 0.01 micron to about 0.3 micron, and from about 0.001 to about 0.1 micron for said black pigment, and said pigments are dispersed into said toner resin uniformly to thereby minimize light scattering and increase color gamut in reflection copy and overhead transparency copy, wherein each of said cyan, magenta, and yellow pigments is dispersed by flushing said cyan, magenta, or yellow pigment into said toner resin, and wherein a cyan, magenta, or yellow pigment water wet cake is mixed with toner resin, and the water is removed to generate pigmented resin containing from about 2 to about 50 weight percent of pigment based on the weight percent of said toner resin and said pigment, and wherein each of the resulting pigmented resin concentrate product is mixed and diluted with additional toner resin to generate cyan, magenta, and yellow toners containing each of said cyan, magenta, or yellow pigment, respectively, in an amount from about 2 to about 15 weight percent; and an imaging process which comprises the generation of an electrostatic image on a photoconductive imaging member followed by the development thereof with a combination, set, or gamut of toners, and wherein four toners are selected and which toners are comprised of a cyan toner, a magenta toner, a yellow toner, and a black toner, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, and the pigment for the black toner is carbon black; thereafter, transferring the developed image to a substrate, and fixing the image thereto.

Embodiments of the present invention also include a toner comprised of a mixture of a cyan toner, a magenta toner, a yellow toner, and a black toner, each of said toners being comprised of resin and pigment, and wherein the pigment for the cyan toner is a β or beta type copper phthalocyanine, the pigment for the magenta toner is a xanthene silicomolybdic acid salt of Rhodamine 6G basic dye, the pigment for the yellow toner is a diazo benzidine, and the pigment for the black toner is carbon black, a cyan toner, a magenta toner, a yellow toner and a black toner, and wherein each toner is comprised of thermoplastic resin and certain pigments, or colorants for each toner, such as for the cyan toner a β (beta) type copper phthalocyanine like Pigment Blue 15:3 having a Color Index Constitution Number of 74160, for the magenta toner a xanthene silicomolybdic acid salt of Rhodamine 6G basic dye like Pigment Red 81:3 having a Color Index Constitution Number of 45160:1, for the yellow toner a diazo benzidine like Pigment Yellow 17, and/or Pigment Yellow 12, and/or Pigment Yellow 13, and/or Pigment Yellow 14 having, respectively, Color Index Constitution Numbers of 21105, 21090, 21100, and 21095, and for the black toner a carbon black, such as those carbon blacks available from Columbian Chemicals, and Cabot Corporation like REGAL 330® carbon black, and the like. The colorants or pigments are present in each toner in various effective amounts, such as from about 2 to about 25, and preferably from about 2 to about 15 weight percent based on the toner components of resin and pigment. Examples of Pigment Blue 15:3 include Heliogen Blue available from BASF, and Phthalocyanine Blue available from Sun Chemicals; examples of Pigment Red 81:3 are FANAL PINK D4830™ available from BASF and Rhodamine Y.S. available from Sun Chemical; examples of Pigment Yellow 17, the preferred pigment in embodiments, is Diarylide AAOA Yellow available from Sun Chemicals; examples of pigment yellow 12, pigment yellow 13, and pigment yellow 14 are diarylide yellow, diarylide yellow, and diarylide yellow available from Sun Chemicals. These color pigments are recited in *The Color Index,* Third Edition, Volumes 1 to 8, the disclosures of which are totally incorporated herein by reference. The amount of each color pigment present is preferably from about 2 to about 15 weight percent based on the toner components of resin and pigment. The exact amount of each pigment present in the toner is determined by the mass of toner deposited on a reflection copy, and adjusting the pigment concentration to achieve the maximum color gamut. This will enable the production of thousands of different colors and/or color shades. This amount can be determined by measuring the chroma of the color image and setting the pigment concentration at or about the maximum chroma. For determination of chroma reference is made to *"Principals of Color Technology, 2nd Edition"*, F. W. Billmeyer, Jr. and M. Saltzman, John Wiley & Son, 1981, the disclosures of which are totally incorporated herein by reference.

Also, in embodiments there are provided toner compositions comprised of a cyan toner, a magenta toner, a yellow toner and a black toner and wherein each toner is comprised of thermoplastic resin and certain pigments, or colorants for each toner, such as for the cyan toner a β type copper phthalocyanine, like Pigment Blue 15:3 having a Color Index Constitution Number of 74160, for the magenta toner a xanthene silicomolybdic acid salt of Rhodamine 6G basic dye like P.R. 81:3 having a Color Index Constitution Number of 45160:3, for the yellow toner a diazo benzidine, like Pigment Yellow 17, and/or Pigment Yellow 12, and/or Pigment Yellow 13, and/or Pigment Yellow 14 having respectively Color Index Constitution Numbers of 21105, 21090, 21100, and 21095, and for the black toner a carbon black such as those carbon blacks available from Columbian Chemicals, and Cabot Corporation, like REGAL 330® carbon black, and the like. The colorants or pigments are present in each toner in various effective amounts, such as from about 2 to about 25, and preferably from about 2 to about 15 weight percent, based on the toner components of, for example, resin and pigment. Examples of Pigment Blue 15:3 include Heliogen Blue available from BASF, and Phthalocyanine Blue available from Sun Chemicals. Examples of Pigment Red 81:3 are FANAL PINK D4830™ available from BASF and Rhodamine Y.S. available from Sun Chemical; examples of Pigment Yellow 17, the preferred pigment, in embodiments is Diarylide AAOA Yellow available from Sun Chemical.

Further, in embodiments there are provided toner compositions comprised of a cyan toner, a magenta toner, a yellow toner and a black toner, and wherein each toner is comprised of thermoplastic resin and certain pigments, or colorants for each toner, such as for the cyan toner a β type copper phthalocyanine, like Pigment Blue 15:3 having a Color Index Constitution Number of 74160, for the magenta toner a xanthene silicomolybdic acid salt of Rhodamine 6G basic dye, P.R. 81:3 like Pigment Red 81:3 having a Color Index Constitution Number of 45160:3, for the yellow toner a diazo benzidine like Pigment Yellow 17, and/or Pigment Yellow 12, and/or Pigment Yellow 13, and/or Pigment Yellow 14 having, respectively, Color Index Constitution Numbers of 21105, 21090, 21100, and 21095, and for the black toner a carbon black, such as those carbon blacks available from Columbian Chemicals, and Cabot Corporation like REGAL 330® carbon black, and the like. The colorants or pigments are present in each toner in various effective amounts such as from about 2 to about 25, and preferably from about 2 to about 15 weight percent based on the toner components of resin and pigment. Examples of Pigment Blue 15:3 include Heliogen Blue available from BASF, and Phthalocyanine Blue available from Sun Chemical; examples of Pigment Yellow 17, the preferred pigment in embodiments, is Diarylide AAO Yellow available from Sun Chemical.

Moreover, in embodiments there are provided toner compositions comprised of a cyan toner, a magenta toner, a yellow toner and a black toner and wherein each toner is comprised of thermoplastic resin and certain pigments, or colorants for each toner, such as for the cyan toner a beta copper phthalocyanine like Pigment Blue 15:3 having a Color Index Constitution Number of 74160, for the magenta toner a monoazo lithol rubine like Pigment Red 57:1 having a Color Index Constitution Number of 15850:1, for the yellow toner and for the black toner a carbon black such as those carbon blacks available from Columbian Chemicals, and Cabot Corporation like REGAL 330™ carbon black, and the like. The colorants or pigments are present in each toner in various effective amounts, such as from about 2 to about 25, and preferably from about 2 to about 15 weight percent based on the toner components of resin and pigment. Examples of Pigment Blue 15:3 include Heliogen Blue available from BASF, and Phthalocyanine Blue available from Sun Chemical.

Additionally, in embodiments there are provided toner compositions comprised of a cyan toner, a magenta toner, a yellow toner and a black toner, and wherein each toner is comprised of thermoplastic resin and certain pigments, or colorants for each toner, such as for the cyan toner β type copper phthalocyanine like Pigment Blue 15:3 having a Color Index Constitution Number of 74160, and/or a metal free phthalocyanine, such as Pigment Blue 16 having a Color Index Constitution Number of 74100, for the magenta toner a xanthene silicomolybdic acid salt of Rhodamine 6G basic dye like Pigment Red 81:3 having a Color Index Constitution Number of 45160, and/or a quinacridone, such as Pigment Red 122 having a Color Index Constitution Number of 73915, and/or a monoazo lithol rubine like Pigment Red 57:1 having a Color Index Constitution Number of 15850:1, for the yellow toner a diazo benzidine like Pigment Yellow 17, and/or Pigment Yellow 12, and/or Pigment Yellow 13, and/or Pigment Yellow 14 having, respectively, Color Index Constitution Numbers of 21105, 21090, 21100, and 21095, and/or an isoindoline like Pigment Yellow 185, and for the black toner a carbon black, such as those carbon blacks available from Columbian Chemicals, and Cabot Corporation, like REGAL 330® carbon black, and the like. The colorants or pigments are present in each toner in various effective amounts, such as from about 2 to about 25, and preferably from about 2 to about 15 weight percent, based on the toner components of resin and pigment. Examples of Pigment Blue 15:3 include Heliogen Blue available from BASF, and Phthalocyanine Blue available from Sun Chemical; examples of Pigment Blue 16 are Heliogen Blue available from BASF, and examples of the other pigments, such as the yellow, are as indicated herein. The aforementioned four toners can be admixed in various effective amounts, such as from about 10 to about 25 weight percent, providing that the total is about 100 weight percent. For mixtures, various effective amounts of each pigment may be selected, for example from about 1 to about 99 weight percent of a first pigment, and from about 99 to 1 weight percent of a second pigment.

In embodiments, there is provided a combination of separate toner compositions comprised of a cyan toner, a magenta toner, a yellow toner and a black toner, and wherein each toner is comprised of thermoplastic resin and certain pigments, or colorants for each toner, such as for the cyan toner β type copper phthalocyanine like Pigment Blue 15:3 having a Color Index Constitution Number of 74160, for the magenta toner a quinacridone, such as Pigment Red 122 having a Color Index Constitution Number of 73915, for the yellow toner an isoindoline yellow like Pigment Yellow 185 with a Color Index Constitution Number of 56290, and for the black toner a carbon black, such as those carbon blacks available from Columbian Chemicals, and Cabot Corporation like REGAL 330® carbon black, and the like. The colorants or pigments are present in each toner in various effective amounts, such as from about 2 to about 25, and preferably from about 2 to about 15 weight percent, based on the toner components of resin and pigment. Examples of Pigment Blue 15:3 include Heliogen Blue available from BASF, and examples of the magenta and yellow are as indicated herein.

In embodiments, there are provided toner compositions comprised of a set of a cyan toner, a magenta toner, a yellow toner and a black toner, and wherein each toner is comprised of thermoplastic resin and certain pigments, or colorants for each toner, such as for the cyan toner a B type copper phthalocyanine like Pigment Blue 15:3 having a Color Index Constitution Number of 74160, for the magenta toner a xanthene silicomolybdic acid salt of Rhodamine 6G basic dye like Pigment Red 81:3, for the yellow toner an isoindoline yellow like Pigment Yellow 185 with a Color Index Constitution Number of 56290, and for the black toner a carbon black, such as those carbon blacks available from Columbian Chemicals, and Cabot Corporation like REGAL 330® carbon black, and the like. The colorants or pigments are present in each toner in various effective amounts, such as from about 2 to about 25, and preferably from about 2 to about 15 weight percent, based on the toner components of resin and pigment. Examples of Pigment Blue 15:3 include Heliogen Blue available from BASF, and examples of the magenta and yellow are as indicated herein such as Paliotol Yellow D1155, FANAL PINK D4830™, or Rhodamine Y.S. available from Sun Chemical.

In embodiments, the present invention relates to a combination of four color toners for the formation of full color images wherein the cyan toner contains Pigment Blue 15:3 and/or Pigment Blue 16, the magenta toner contains Pigment Red 81:3 and/or Pigment Red 122 and/or Pigment Red 57:1, and the yellow toner contains Pigment Yellow 17, Pigment Yellow 12, Pigment Yellow 13, 14, and/or pigment Yellow 185, and wherein the ration of 15:3 to 16 can be adjusted to meet, or minimize hazardous waste regulations relative to the disposal of copper for example.

Also, embodiments of the present invention include a xerographic imaging and printing apparatus comprised in operative relationship of an imaging member component, a charging component, development components, a transfer component, and a fusing component, and wherein said development components include therein carrier and a combination of four color toners, and wherein the four toners are comprised of a cyan toner, a magenta toner, a yellow toner, and a black toner, as illustrated herein, respectively, each of said toners being comprised, for example, of resin and pigment and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, and the pigment for the black toner is carbon black, and wherein in embodiments said developer components are comprised of four separated housings, and wherein one housing contains the cyan toner, the second housing contains a magenta toner, the third housing contains the yellow toner, and the fourth housing contains the black toner, each of said toners being comprised of resin and pigment, and wherein the pigment for the cyan toner is a β copper phthalocyanine, the pigment for the magenta toner is a xanthene silicomolybdic acid salt of Rhodamine 6G basic dye, the pigment for the yellow toner is a diazo benzidine, and the pigment for the black toner is carbon black, wherein said cyan pigment is Pigment Blue 15:3 having a Color Index Constitution Number of 74160, said magenta pigment is Pigment Red 81:3 having a Color Index Constitution Number of 45160:3, said yellow pigment is pigment Yellow 17 having a Color Index Constitution Number of 21105, and the imaging member is comprised of a photogenerating layer and a charge transport layer. The cyan, magenta, yellow, and black toners, respectively, and illustrated herein can be incorporated into the separate developer housings.

Of importance when preparing the toner in embodiments is the selection of a wet pigment, or wet cake of pigment, that is a pigment that has been wetted with water and not a dry pigment. These pigments are flushed by known methods into the toner resin by the mixing thereof with toner resin and heating, for example, at a temperature of from about 50° to about 125° C., and wherein the water is removed. Solvents, such as organic solvents like toluene, xylene, and the like, can be added in effective amounts to the wet pigment prior to mixing with the toner resin. In embodiments, the pigment concentration in the toner product resulting after heating and cooling is from about 5 to about 50, and preferably from about 25 to about 50 weight percent. Thereafter, the product of toner resin and pigment can be diluted by adding thereto further toner resin, such as a polyester, and wherein the amount of pigment present is reduced, for example, from 50 weight percent to from about 20 to about 40 weight percent.

The toner compositions of the present invention can be prepared in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include thermoplastics such as polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polyesters generally, such as the polymeric esterification products of a dicarboxylic acid and a diol comprising a diphenol, reference the known linear polyesters, the polyesters of U.S. Pat. No. 3,590,000, the disclosure of which is totally incorporated herein by reference, the SPAR™ polyesters commercially available, and the like. Vinyl monomers include styrene, p-chlorostyrene, unsaturated mono-olefins such as ethylene, propylene, butylene, isobutylene, and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof, and the like; styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers and polyesters, such as those illustrated in U.S. Pat. No. 3,681,106, the disclosure of which is totally incorporated herein by reference, may be selected. Examples of specific toner resins include styrene n-butyl methacrylate, styrene n-butyl acrylate, styrene butadiene with from 80 to 91 weight percent styrene, and PLIOTONES®, which are believed to be styrene butadienes available from Goodyear Chemicals.

As one preferred toner resin, there can be selected the esterification products of a dicarboxylic acid and a diol comprising a diphenol, such as SPAR™ polyesters available from Resana of Brazil. These resins are generally illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a weight average molecular weight of from about 1,000 to about 20,000, and preferably from about 1,000 to about 10,000, such as polyolefins like polyethylene, polypropylene, and paraffin waxes, can be included in, or on the toner compositions as, for example, fuser roll release agents. These low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Also, the extruded polyesters as illustrated In U.S. Pat. Nos. 5,376,494 and 5,227,460, the disclosures of which are totally incorporated herein by reference, can be selected as the toner resin. More specifically, these polyesters are comprised of crosslinked and linear portions, the crosslinked portion consisting essentially of microgel particles with an average volume particle diameter up to 0.1 micron, preferably about 0.005 to about 0.1 micron, the microgel particles being substantially uniformly distributed throughout the linear portions. The extruded polyesters in embodiments are comprised of crosslinked portions consisting essentially of microgel particles, preferably up to about 0.1 micron in average volume particle diameter, as determined by scanning electron microscopy and transmission electron microscopy. When produced by a reactive melt mixing process wherein the crosslinking occurs at high temperature and under high shear, the size of the microgel particles does not usually continue to grow with increasing degree of crosslinking. Also, the microgel particles are distributed substantially uniformly throughout the linear portion.

The crosslinked portions or microgel particles are prepared in a manner that there is substantially no distance between the polymer chains. Thus, the crosslinking is preferably not accomplished via monomer or polymer bridges. The polymer chains are directly connected, for example, at unsaturation sites or other reactive sites, or in some cases by a single intervening atom such as, for example, oxygen. Therefore, the crosslinked portions are very dense and do not swell as much as gel produced by conventional crosslinking methods. This crosslink structure is different from conventional crosslinking in which the crosslink distance between chains is quite large with several monomer units, and where the gels swell very well in a solvent such as tetrahydrofuran or toluene. These highly crosslinked dense microgel particles distributed throughout the linear portion impart elasticity to the resin which improves the resin offset properties, while not substantially affecting the resin minimum fix temperature.

The polyesters in embodiments are preferably comprised of a partially crosslinked unsaturated resin such as unsaturated polyester prepared by crosslinking a linear unsaturated resin, or base resin, such as linear unsaturated polyester resin preferably with a chemical initiator in a melt mixing device such as, for example, an extruder at high temperature (e.g., above the melting temperature of the resin and preferably up to about 150° C. above that melting temperature) and under high shear. In preferred embodiments, the base resin has a degree of unsaturation of about 0.1 to about 30 mole percent, preferably about 5 to about 25 mole percent. The shear levels should be sufficient to inhibit microgel growth above about 0.1 micron average particle diameter and to ensure substantially uniform distribution of the microgel particles, which shear levels are readily available in melt mixing devices such as extruders.

The polyester toner resin possesses, for example, a weight fraction of the microgel (gel content)in the resin mixture in the range typically of from about 0.001 to about 50 weight percent, preferably about 0.1 to about 40 or 10 to 19 weight percent. The linear portion is comprised of base resin, preferably unsaturated polyester, in the range of from about 50 to about 99.999 percent by weight of said toner resin, and preferably in the range of from about 60 to about 99.9 or 81 to 90 percent by weight of the toner resin. The linear portion of the resin preferably is comprised of low molecular weight reactive base resin which did not crosslink during the crosslinking reaction, preferably unsaturated polyester resin. In embodiments, the number-average molecular weight ($M_n$) of the linear portion as measured by gel permeation chromatography (GPC) is in the range typically from about 1,000 to about 20,000, and preferably from about 2,000 to about 5,000. The weight-average molecular weight ($M_w$) of the linear portion is in the range typically from about 2,000 to about 40,000, and preferably from about 4,000 to about 15,000. The molecular weight distribution ($M_w/M_n$) of the linear portion is in the range typically from about 1.5 to about 6, and preferably from about 2 to about 4. The onset glass transition temperature ($T_g$) of the linear portion as measured by differential scanning calorimetry (DSC) for preferred embodiments is in the range typically from about 50° C. to about 70° C., and preferably from about 51° C. to about 60° C. Melt viscosity of the linear portion of preferred embodiments as measured with a mechanical spectrometer at 10 radians per second is from about 5,000 to about 200,000 poise, and preferably from about 20,000 to about 100,000 poise at 100° C., and drops sharply with increasing temperature to from about 100 to about 5,000 poise, and preferably from about 400 to about 2,000 poise, as the temperature rises from 100° C. to 130° C.

The polyester toner resin thus contains for example a mixture of crosslinked resin microgel particles and a linear portion as illustrated herein. In embodiments, the toner resin onset $T_g$ is in the range typically from about 50° C. to about 70° C., and preferably from about 51° C. to about 60° C., and the melt viscosity as measured with a mechanical spectrometer at 10 radians per second is from about 5,000 to about 200,000 poise, and preferably from about 20,000 to about 100,000 poise, at 100° C. and from about 10 to about 20,000 poise at 160° C.

There can be blended with the toner compositions of the present invention external additive particles including flow aid additives, which additives are usually present on the surface thereof. Examples of these additives include colloidal silicas such as the AEROSILS® like AEROSIL R972®, available from DeGussa Chemicals, mixtures of AEROSILS® in embodiments, metal salts and metal salts of fatty acids inclusive of zinc stearate, metal oxides, such as aluminum oxides, titanium oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with charge additives in an amount of from about 1 to about 30 weight percent and preferably 10 weight percent, followed by the addition thereof to the toner in an amount of from 0.1 to 10 and preferably 0.1 to 1 weight percent.

Also, as indicated herein there can be included in the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K.K., and similar waxes. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyolefins, such as polyethylene and polypropylene selected for the toners of the present invention are illustrated in British Patent 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Various known suitable effective positive or negative charge enhancing additives can be selected for incorporation into the toner compositions of the present invention, preferably in an amount of about 0.1 to about 10, more preferably about 1 to about 3, percent by weight. Examples include quaternary ammonium compounds inclusive of alkyl pyridinium halides; alkyl pyridinium compounds, reference U.S. Pat. No. 4,298,672, the disclosure of which is totally incorporated herein by reference; organic sulfate and sulfonate compositions, U.S. Pat. No. 4,338,390, the disclosure of which is totally incorporated herein by reference; bisulfonates; ammonium sulfates (DDABS); distearyl dimethyl ammonium bisulfate (DDAMS), reference U.S. Pat. No. 5,114,821, the disclosure of which is totally incorporated herein by reference; cetyl pyridinium tetrafluoroborates; distearyl dimethyl ammonium methyl sulfate; aluminum salts, such as BONTRON E84™ or E88™ (Hodogaya Chemical); quaternary ammonium nitrobenzene sulfonates; mixtures of charge enhancing additives, such as DDAMS and DDABS; other known charge additives; and the like. Moreover, effective known internal and external additives may be selected for the toners of the present invention in embodiments thereof.

The invention toners can be formulated into developer compositions by the mixing thereof with carrier particles. Illustrative examples of carriers that can be selected for mixing with the toner compositions include those carriers that are capable of triboelectrically obtaining a charge of opposite polarity to that of the toner particles. Accordingly, in embodiments the carrier particles may be selected so as to be of a negative or of a positive polarity in order that the toner particles, which are positively or negatively charged, will adhere to and surround the carrier particles. Illustrative examples of carriers include granular zircon, granular silicon, glass, steel, iron, nickel, ferrites, such as copper zinc ferrites, copper manganese ferrites, and strontium hexaferrites, silicon dioxide, and the like. Additionally, there can be selected as carrier particles nickel berry carriers as disclosed in U.S. Pat. No. 3,847,604, the entire disclosure of which is hereby totally incorporated herein by reference, and which carriers are, for example, comprised of nodular carrier beads of nickel, characterized by surfaces of reoccurring recesses and protrusions thereby providing particles with a relatively large external area. Other carriers are illustrated in U.S. Pat. Nos. 3,590,000; 4,937,166 and 4,935,326, the disclosures of which are totally incorporated herein by reference. In embodiments, mixtures of coatings, such as KYNAR® and PMMA as illustrated in the aforementioned U.S. Pat. Nos. 4,937,166 and 4,935,326, mixtures of three polymers, mixtures of four polymers, polymer mixture pairs wherein each pair contains a conductive carrier coating and an insulating carrier coating, can be selected. The carrier coating can be selected in various effective amounts, such as for example from about 0.1 to about 10, and preferably from about 1 to about 3 weight percent. Also, in embodiments the carrier core may be entirely coated on the surface thereof, or partially coated.

The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings, such as fluoropolymers like KYNAR®, TEFLON OXY 461® available from Occidental Chemicals; and the like. The carrier particles may also include in the coating, which coating can be present in embodiments in an amount of from about 0.1 to about 3 weight percent, conductive substances, such as carbon black, in an amount of from about 5 to about 30 percent by weight. Polymer coatings not in close proximity in the triboelectric series can also be selected as indicated herein, reference KYNAR® and polymethylmethacrylate (PMMA) mixtures (40/60) as illustrated in U.S. Pat. Nos. 4,937,166 and 4,935,326, the disclosures of which are totally incorporated herein by reference. Coating weights can vary as indicated herein; generally, however, in embodiments from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from about 60 to about 100 microns thereby permitting them to possess sufficient density and inertia to avoid adherence to the electrostatic images during the development process. The carrier component can be mixed with the toner in various suitable combinations, such as from about 1 to 5 parts per toner to about 100 parts to about 200 parts by weight of carrier.

The toner and developer compositions of the present invention may be selected for use in electrostatographic imaging apparatuses containing therein conventional photoreceptors providing that they are capable of being charged negatively. The toner and developer compositions of the present invention can be used with layered photoreceptors, or photoconductive imaging members that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Preferred imaging members include the layered imaging members with a supporting substrate, a photogenerating layer and a charge transport layer.

The following Examples are being provided to illustrate various embodiments of the present invention, it being noted that these Examples are intended to illustrate and not limit the scope of the present invention. Parts and percentages are by weight unless otherwise indicated. Weight percent refers, for example, to the amount of component divided by the total amount of components, for example for the toner the weight percent of pigment is based on the weight percent of the toner components of resin, pigment, and optional charge additive In the Examples about 3 parts of toner and 97 parts of the Xerox Corporation carrier were selected.

EXAMPLE I

Pigment Blue 15:3 having a Color Index Constitution Number 74160 was predispersed in a propoxylated bisphenol A linear polyester resin commercially available and illustrated in U.S. Pat. No. 3,590,000, the disclosure of which is totally incorporated herein by reference, by using a flushing procedure as follows.

In an Aaron Process Company lab mixer equipped with a two horsepower direct connect gear motor and mixing blades of sigma design with front blade speed set at 60 RPM and back blade speed set at 34 RPM (a flusher), 1,600 grams of the linear polyester plus 160 grams of toluene were mixed and heated to 65° C. until the resin was completely dissolved. The Pigment Blue 15:3 was added in three aliquots to the mix in the wet cake form which is a 50/50 weight ratio of Pigment Blue 15:3 and water as follows. 1,000 Grams of Pigment Blue 15:3 wet cake (which contains 50 percent of water) were added to the resin/toluene mixture. The water from the wet cake pigment was displaced by the resin/toluene solution (flushed) and the water was decanted. Another 567 grams of the same wet cake was added to the mix, allowed to mix, and the water was displaced from the pigment and decanted. Finally, the last aliquot of wet cake, 567 grams, was added and allowed to mix with the resin/toluene, and for a third time the water was displaced from the pigment, and again the water was decanted. The mixture of resin/toluene/pigment was further mixed for one hour at 65° C. The mixture was then subjected to vacuum to remove the toluene and any entrapped water from the resin/pigment mixture. The mixture was then cooled and crushed to a powder. The resulting Pigment Blue 15:3 flush contained 60/40 weight ratio of resin/pigment.

A toner was prepared with the above prepared predispersed pigment utilizing a Werner & Pfleiderer ZSK-28 twin screw extruder with the following process conditions: barrel temperature profile of 105°/110°/110°/115°/115°/115°/120° C., die head temperature of 140° C., screw speed of 250 revolutions per minute and average residence time of about three minutes. With the processing rate at 6 pounds per hour, a mixture of 90 parts of the above linear polyester resin obtained from bisphenol A, fumaric acid and propylene glycol, and 10 parts of the Pigment Blue 15:3 flush were mixed. The resulting mixture was then cooled, micronized and classified using conventional jet mill process to 7 microns average volume median size. The resulting cyan colored toner contained 96 parts of the linear polyester resin and 4 parts of Pigment Blue 15:3, which pigment had a particle size of 0.1 micron average particle diameter as measured by transmission electron microscopy.

EXAMPLE II

The process of Example I was repeated except that a magenta toner was prepared using Pigment Red 81:3 in place of the Pigment Blue 15:3.

The resulting magenta colored toner contained 96 parts of the linear polyester resin and 4 parts of Pigment Red 81:3, which pigment had a particle size of 0.1 micron average particle diameter as measured by transmission electron microscopy.

EXAMPLE III

Repeating the procedure of Example I, a yellow toner was prepared using Pigment Yellow 185 in place of of the Pigment Blue 15:3.

The resulting yellow colored toner contained 96 parts of the linear polyester resin and 4 parts of Pigment Yellow 185, which had a particle size of 0.3 micron average particle diameter as measured by transmission electron microscopy.

EXAMPLE IV

A full process color image was generated using the combination of toners of Examples I, II and III as follows.

Each of the toners from Examples I, II and III were blended with surface additives of 0.3 percent of zinc stearate, 0.9 percent of fumed silica and 1.1 percent of fumed titanium dioxide, and mixed with a Xerox Corporation carrier, 65 micron Hoeganese core coated with 0.75 weight percent polymethylmethacrylate/carbon black mixture of 80/20 weight percent ratio to enable three separate developers.

The developers with the toners of Examples I, II and III, respectively, were placed in three separate housings, respectively, that is the toner of Example I was placed in a first developer housing, the toner of Example II was placed in a second developer housing, and the toner of Example III was placed in a third separate housing in a Xerox Corporation test fixture similar to the Xerox Corporation 5775, a full process color machine, and prints, or copies of original documents were generated and fused to a gloss value of 63, as measured by a Pacific Scientific Company Glossguard II model glossmeter. The resulting print brightness and saturation of colors of the image showed that this (the above toners) combination of colorants or pigments predispersed as described in Example I provided a large color gamut, and wherein each color reproduced was of excellent chroma and superior resolution.

EXAMPLE V

A black toner was prepared as follows. In a Werner & Pfleiderer ZSK-28 twin screw extruder using the following process conditions: barrel temperature profile of 105°/110°/110°/115°/115°/115°/120° C., die head temperature of 140° C., screw speed of 250 revolutions per minute and average residence time of about three minutes with a processing rate of 6 pounds per hour, a mixture of 95 parts of the Example I linear polyester resin and 5 parts of carbon black REGAL 330® were mixed. The mixture was cooled (to about room temperature, 25° C. throughout) then micronized and classified using conventional jet mill process to 7 microns average volume median size. The resulting black colored toner contained 95 parts of linear polyester resin and 5 parts carbon black, which carbon black pigment had a particle size of 0.01 micron average particle diameter as measured by transmission electron microscopy.

EXAMPLE VI

A number of full process color images were generated with the combination of toners of Examples I, II, III and V as follows and similar to the process as illustrated in Example IV.

Each of the toners from Example I, II, III and V were blended with surface additives, 0.3 percent of zinc stearate, 0.9 percent of the fumed silica AEROSIL R972®, and 1.1 percent of fumed titanium dioxide, followed by mixing with the Xerox Corporation carrier of Example IV (65 micron Hoeganese core coated with polymethylmethacrylate and carbon black) to generate a combination of four separate developers.

The developers were placed in a test fixture similar to the Xerox Corporation 5775, a full process color machine, and prints and copies of original documents were generated and fused to a gloss value of 63, as measured by a Pacific Scientific Company Glossguard II model glossmeter. The resulting brightness and saturation of colors of the images showed this combination of colorants predispersed as described in Example I and the carbon black toner of Example V provided a large color gamut. For example, reds like Pantone Warm Red C, blues like Pantone Reflex Blue C, greens like Pantone Green C, and yellows like Pantone Yellow 12 C and Yellow C were generated.

EXAMPLE VII

By repeating the procedure of Example I a yellow toner was prepared with Pigment Yellow 17 instead of Pigment Blue 15:3.

The resulting yellow colored toner contained 96 parts of linear polyester resin and 4 parts of Pigment Yellow 17, which pigment had a particle size of 0.1 micron average particle diameter as measured by transmission electron microscopy.

EXAMPLE VIII

A number of full process color images were generated with the combination of toners of Examples I, II and VII as follows.

Each of the toners of Examples I, II and VII were blended with surface additives (0.3 percent of zinc stearate, 0.9 percent of fumed silica and 1.1 percent of fumed titanium dioxide) and mixed with the Xerox Corporation carrier, Xerox part #F3C-1, (65 micron Hoeganese core coated with polymethylmethacrylate and carbon black) to generate three separate developers.

The developers were placed in a test fixture similar to the Xerox Corporation 5775, a full process color machine, and prints were generated and fused to a gloss value of 63, as measured by a Pacific Scientific Company Glossguard II model glossmeter. The resulting brightness and saturation of colors like dark wine red, bright sky blue, grass greens, and the like of the images showed this combination of colorants predispersed as described in Example I to provide a large color gamut, and wherein the color of the prints or copies were of equal color intensity as that of the originals as determined, for example, by visual observations.

EXAMPLE IX

A full process color image was prepared with the combination of toners of Examples I II, V and VII as follows.

Each of the toners from Example I, II, V and VII were blended with surface additives (0.3 percent of zinc stearate, 0.9 percent of fumed silica and 1.1 percent of fumed titanium dioxide) and mixed with a Xerox Corporation carrier, Xerox part #F3C-1, (65 micron Hoeganese core coated with polymethylmethacrylate and carbon black) to generate a combination of four separate developers.

The developers were placed in a test fixture similar to the Xerox Corporation 5775, a full process color machine, and prints of originals were made and fused to a gloss value of 63, as measured by a Pacific Scientific Company Glossguard II model glossmeter. The resulting brightness and saturation of colors of the developed images generated in the Xerox Corporation 5775 showed this combination of colorants predispersed as described in Example I and the carbon black toner of Example V provided a large color gamut, including colors like Pantone Rhodamine Red C, Pantone Red 032 C and Pantone Rubine Red C, and wherein the color of the prints or copies were of equal color intensity as that of the originals as determined, for example, by visual observations.

EXAMPLE X

By repeating the procedure of Example I, a magenta toner was prepared using Pigment Red 122 in place of the 15:3.

The resulting magenta colored toner contained 96 parts of the linear polyester resin and 4 parts of Pigment Red 122, which had a particle size of 0.1 micron average particle diameter as measured by transmission electron microscopy.

EXAMPLE XI

A number of full process color images were generated using the combination of toners of Examples I, VII and X as follows.

Each of the toners from Example I, VII and X were blended with surface additives (0.3 percent of zinc stearate, 0.9 percent of fumed silica and 1.1 percent of fumed titanium dioxide) and mixed with a Xerox Corporation carrier, Xerox part #F3C-1, (65 micron Hoeganese core coated with polymethylmethacrylate and carbon black) to provide three separate developers.

The developers were placed in a Xerox full process color machine similar to the 5775, and prints were made and fused to a gloss value of 63, as measured by a Pacific Scientific Company Glossguard II model glossmeter. The resulting brightness and saturation of colors of the developed images evidenced that this combination of colorants or pigments predispersed as described in Example I provided a large color gamut, and wherein the color of the prints or copies were of equal color intensity as that of the originals as determined, for example, by visual observations.

EXAMPLE XII

A number, exceeding 1,000, of full process color images were generated using the combination of toners of Examples I, VII, X and V as follows.

Each of the toners from Example I, VII, X and V were blended with surface additives (0.3 percent of zinc stearate, 0.9 percent of fumed silica and 1.1 percent of fumed titanium dioxide) and mixed with the above carrier, 65 micron Hoeganese core coated with polymethylmethacrylate and carbon black, to make four separate developers. Unless otherwise indicated, about 3 parts of toner to about 97 parts of carrier were selected for the developers illustrated in the Examples.

The developers were placed in a Xerox Corporation prototype full process color machine, and prints were made and fused to a gloss value of 63, as measured by a Pacific Scientific Company Glossguard II model glossmeter. The resulting brightness and saturation of colors of the developed images generated showed that this combination of colorants predispersed as described in Example I and the carbon black toner of Example V provided a large color gamut with colors of black, red, yellow, blue, green, and brown that were equal in resolution and color brightness to the original and in some instances the colors of the original were enhanced.

EXAMPLE XIII

A number of full process color images were generated using the combination of toners of Examples I, III and X as follows.

Each of the toners from Examples I, III and X were blended with surface additives (0.3 percent of zinc stearate, 0.9 percent of fumed silica and 1.1 percent of fumed titanium dioxide) and mixed with the above Xerox Corporation carrier (65 micron Hoeganese core coated with polymethylmethacrylate and carbon black) to provide three separate developers.

The developers were placed in a Xerox prototype full process color machine and a number of prints, for example about 1,000, were generated and fused to a gloss value of 63, as measured by a Pacific Scientific Company Glossguard II model glossmeter. The resulting brightness and saturation of colors of the image showed that this combination of colorants predispersed as described in Example I provided a large color gamut, and wherein all the colors of the originals were reproduced.

EXAMPLE XIV

Full process color images were generated using the combination of toners of Examples I, III, X and V as follows. Each of the toners from Examples I, III, X and V were blended with surface additives (0.3 percent of zinc stearate, 0.9 percent of fumed silica and 1.1 percent of fumed titanium dioxide) and mixed with 97 parts of the above Xerox carrier (65 micron Hoeganese core coated with polymethylmethacrylate and carbon black) to provide four separate developers. Each of the developers were placed in a separate developer housing contained in the full process color test fixture machine.

The developers were placed in a Xerox prototype full process color test fixture machine, and prints were generated and fused to a gloss value of 63, as measured by a Pacific Scientific Company Glossguard II model glossmeter. The resulting brightness and saturation of colors of the images indicated that this combination of colorants predispersed as described in Example I and the carbon black toner of Example V provided a large color gamut, and wherein all the colors of the originals were reproduced.

EXAMPLE XV

By repeating the procedure of Example I, a magenta toner was prepared using Pigment Red 57:1 in place of the 15:3.

The resulting magenta colored toner contained 96 parts of the linear polyester resin and 4 parts of Pigment Red 57:1, which had a particle size of 0.1 micron average particle diameter as measured by transmission electron microscopy.

EXAMPLE XVI

A number of full process color images were generated using the combination of toners of Examples I, III and XV as follows.

Each of the toners from Examples I, III and XV were blended with surface additives (0.3 percent of zinc stearate, 0.9 percent of fumed silica and 1.1 percent of fumed titanium dioxide) and mixed with the above Xerox Corporation carrier, Xerox part #F3C-1, (65 micron Hoeganese core coated with polymethylmethacrylate and carbon black) to enable three separate developers.

The developers were placed in a Xerox prototype full process color machine, and prints were made and fused to a gloss value of 63, as measured by a Pacific Scientific Company Glossguard II model glossmeter. The resulting brightness and saturation of colors of the images indicated that this combination of colorants predispersed as described in Example I provided a large color gamut, and wherein all the colors of the originals were reproduced. "Placed" refers herein, for example, to loading each separate developer housing of the full process color machine with different toners, such as the toners of Examples I, III and XV, respectively, and wherein each housing contains carrier.

EXAMPLE XVII

A number of full process color images was generated (from originals throughout) using the combination of toners of Examples I, III, XV and V as follows.

Each of the toners from Examples I, III, XV and V were blended with surface additives (0.3 percent of zinc stearate, 0.9 percent of fumed silica and 1.1 percent of fumed titanium dioxide) and mixed with 97 parts of a Xerox Corporation carrier, Xerox part #F3C-1, (65 micron Hoeganese core coated with polymethylmethacrylate and carbon black) to provide a combination, or set of four separate developers.

The developers were placed in a Xerox prototype full process color test machine (similar to the Xerox Corporation 5775 throughout), and prints were generated and fused to a gloss value of 63, as measured by a Pacific Scientific Company Glossguard II model glossmeter. The resulting brightness and saturation of colors of the developed images indicated that this combination of colorants predispersed as described in Example I and the carbon black toner of Example V provided a large color gamut, and wherein all the colors of the originals were reproduced.

EXAMPLE XVIII

A number of full process color images were generated using the combination of toners of Examples I, VII and XV as follows.

Each of the toners of Examples I, VII and XV were blended with surface additives (0.3 percent of zinc stearate, 0.9 percent of fumed silica and 1.1 percent of fumed titanium dioxide) and mixed with a Xerox Corporation carrier, Xerox part #F3C-1, (65 micron Hoeganese core coated with polymethylmethacrylate and carbon black) to make three separate developers.

The developers were placed in a Xerox prototype full process color test machine, and prints were generated and fused to a gloss value of 63, as measured by a Pacific Scientific Company Glossguard II model glossmeter. The resulting brightness and saturation of colors of the image indicated that this combination of colorants (toner of resin and pigment colorant) predispersed as described in Example I provided a large color gamut, and wherein all the colors of the originals were reproduced.

EXAMPLE XIX

A number of full process color images were generated using the combination of unmixed separate toners of Examples I, VII, XV and V as follows.

Each of the toners from Examples I, VII, XV and V were blended with surface additives (0.3 percent of zinc stearate, 0.9 percent of fumed silica and 1.1 percent of fumed titanium dioxide) and mixed with the Xerox Corporation carrier, Xerox part #F3C-1, (65 micron Hoeganese core coated with polymethylmethacrylate and carbon black) to make four separate developers.

The developers were placed in a Xerox prototype full process color test machine, and prints were generated and fused to a gloss value of 63, as measured by a Pacific Scientific Company Glossguard II model glossmeter. The resulting brightness and saturation of colors of the image showed that this combination of colorants predispersed as described in Example I and the carbon black toner of Example V provided a large color gamut, and wherein all the colors of the originals were reproduced.

EXAMPLE XX

A number of full process color image was prepared with the combination of toners of Examples I, II, VII and V as follows.

Each of the toners of Examples I, II, VII and V were blended with surface additives (0.3 percent of zinc stearate, 0.9 percent of fumed silica and 1.1 percent of fumed titanium dioxide) and mixed with 97 parts of a Xerox Corporation carrier, Xerox part #F3C-1, (65 micron Hoeganese core coated with polymethylmethacrylate and carbon black) to generate four separate developers.

The developers were placed in a test fixture similar to the Xerox Corporation 5775, and transparencies were generated and fused to a gloss value of 69, as measured by a Pacific Scientific Company Glossguard II model glossmeter. The resulting brightness and saturation of colors of the projected images on the overhead screen showed that this combination of colorants predispersed as described in Example I and the carbon black toner of Example V provided extremely clean, bright and saturated colors.

Similarly, a number of full process color images can be generated with the combination of toners of the present invention illustrated herein and wherein the pigments are as indicated, and wherein a large color gamut was provided, and wherein all the different colors of the originals were reproduced. Colors reproduced include the full array or gamut of colors, and shades thereof such as red, pink, green, brown, black, yellow, blue, light blue, dark blue, navy, light green, dark green, medium green, light red, dark red, medium red, light black, dark black, medium black, gray, whites, creams, oranges, combinations or mixtures thereof, and the like. Thus, in embodiments there can be reproduced from originals in the Xerox Corporation 5775 test fixture with the specific combination of toners and developers of the present invention a numerous variety or gamut of colors equal to the colors of the originals.

In embodiments, the dilution indicated herein to other pigment concentrations is not selected since, for example, the mass of the toners on the image controls the amount of pigment used.

Other modifications of the present invention may occur to those skilled in the art subsequent to a review of the present application, and these modifications, including equivalents thereof, are intended to be included within the scope of the present invention.

What is claimed is:

1. A combination of four color toners comprised of a cyan toner, a magenta toner, a yellow toner, and a black toner, each of said toners being comprised of resin and pigment, and wherein the pigment for the cyan toner is β type copper phthalocyanine, the pigment for the magenta toner is a xanthene silicomolybdic acid salt of Rhodamine 6G dye, the pigment for the yellow toner is an isoindoline, and the pigment for the black toner is carbon black, and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigment into said toner resin and wherein prior to flushing a cyan, magenta and yellow pigment water wet cake is mixed with said toner resin and the water is substantially removed to generate pigmented resin.

2. A toner in accordance with claim 1 wherein said cyan pigment is Pigment Blue 15:3 having a Color Index Constitution Number of 74160, said magenta pigment is Pigment Red 81:3 having a Color Index Constitution Number of 73915, and said yellow pigment is Pigment Yellow 185 having a Color Index Constitution Number of 56290.

3. A toner in accordance with claim 1 wherein each of said pigments is present in an amount of from about 2 to about 25 weight percent.

4. A toner in accordance with claim 1 wherein each of said pigments is present in an amount of from about 2 to about 15 weight percent.

5. A toner in accordance with claim 1 wherein each of said pigments is present in an amount of from about 2 to about 10 weight percent.

6. A toner in accordance with claim 1 wherein each of said cyan, magenta, and yellow pigments has a particle diameter size or agglomerate diameter size of from about 0.01 micron to about 0.3 micron, and said pigments are dispersed into said toner resin uniformly to thereby minimize light scattering and increase color gamut in reflection copy and overhead transparency copy.

7. A toner in accordance with claim 1 wherein each of said cyan, magenta, and yellow pigments is dispersed by flushing said cyan, magenta, or yellow pigments into said toner resin, and wherein a cyan, magenta, or yellow pigment water wet cake is mixed with toner resin and the water is removed to generate pigmented resin containing from about 30 to about 40 weight percent of pigment by weight, and wherein each of the resulting pigmented resin concentrate product is mixed and diluted with additional toner resin to generate cyan, magenta, and yellow toners containing each of said cyan, magenta, or yellow pigments, respectively, in an amount of from about 2 to about 15 weight percent.

8. A toner in accordance with claim 1 wherein the resin for each toner is a styrene acrylate, a styrene methacrylate, a styrene butylmethacrylate, a polyester, or a styrene butadiene.

9. A toner in accordance with claim 1 wherein the resin for each toner is a linear polyester, a crosslinked polyester, a gel containing polyester, or a mixtures thereof.

10. A toner in accordance with claim 9 wherein the linear polyester resin, crosslinked polyester resin, or gel containing polyester is prepared from the condensation reaction of fumaric acid with propoxylated bisphenol A.

11. A toner in accordance with claim 10 wherein the polyester resin is present in an amount of from about 75 to about 98 weight percent.

12. A toner in accordance with claim 11 wherein the fused images obtained with said toners have a Gardner Gloss value of from about 10 to 80 gloss units.

13. A toner in accordance with claim 11 wherein the fused image obtained with said toner has a Gardner Gloss value of from about 40 to 70 gloss units.

14. A toner in accordance with claim 11 wherein from about 70 to about 98 percent of the transmitted light passing through a fused image contained on a transparency reaches a projection screen from an overhead projector, and wherein said fused image has been developed with said toner.

15. A toner in accordance with claim 14 wherein from about 85 to about 95 percent of the transmitted light passing through a fused image on a transparency reaches a projection screen.

16. A toner in accordance with claim 1 wherein there is included in each toner a charge enhancing additive, and there is included thereon of each toner surface additives.

17. A toner in accordance with claim 16 wherein the surface additives are comprised of fumed silica, metal oxides, metal salts of fatty acids, or mixtures thereof.

18. A toner in accordance with claim 17 wherein the surface additives are present in an amount of from about 0.1 to about 3 weight percent.

19. Developers comprised of a combination of four color toners comprised of a cyan toner, a magenta toner, a yellow toner, and a black toner, each of said toners being comprised of resin and pigment, and wherein the pigment for the cyan toner is β type copper phthalocyanine, the pigment for the magenta toner is a xanthene silicomolybdic acid salt of Rhodamine 6G dye, the pigment for the yellow toner is an isoindoline, and the pigment for the black toner is carbon black, and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigment into said toner resin and wherein a cyan, magenta and yellow pigment water wet code is mixed with said toner resin and the water is substantially removed to generate pigmented resin, and carrier particles.

20. A developer composition in accordance with claim 19 wherein the carrier particles are comprised of ferrites, steel, or an iron powder with a coating thereover.

21. A toner in accordance with claim 1 with a triboelectric charge of from about 10 to about 40 microcoulombs.

22. A combination, set, or gamut of four color toners each for the development of electrostatic latent images enabling the formation of a full color gamut image, and wherein the four toners consist essentially of a cyan toner, a magenta toner, a yellow toner, and a black toner, each of said toners being comprised of resin and pigment, and wherein the pigment for the cyan toner is a β type copper phthalocyanine, the pigment for the magenta toner is a xanthene silicomolybdic acid salt of Rhodamine 6G dye, the pigment for the yellow toner is an isoindoline, and the pigment for the black toner is carbon black and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigments into said toner resin and wherein prior to flushing a cyan, magenta and yellow pigment water wet cake is mixed with said toner resin and the water is removed to generate pigmented resin containing from about 25 to about 50 weight percent of pigment based on the weight percent of said toner resin and said pigment; and wherein each of the resulting pigmented resin concentrated products is mixed and diluted with additional toner resin to generate cyan, magenta and yellow toners containing each of said cyan, magenta or yellow pigments, respectively, in an amount of from about 2 to about 15 weight percent.

23. A combination of toners in accordance with claim 22 wherein the fused image obtained with said toner combination has a Gardner Gloss value of from about 40 to 70 gloss units, wherein from about 70 to about 98 percent of the transmitted light passing through said fused image contained on a transparency reaches a projection screen from an overhead projector.

24. An imaging process which comprises the generation of an electrostatic image on a photoconductive imaging member followed by the development thereof with a combination, set, or gamut of toners, and wherein four toners are selected, and which toners are comprised of a cyan toner, a magenta toner, a yellow toner, and a black toner, each of said toners being comprised of resin and pigment, and wherein the pigment for the cyan toner is a β type copper phthalocyanine, the pigment for the magenta toner is a xanthene silicomolybdic acid salt of Rhodamine 6G dye, the pigment for the yellow toner is an isoindoline, and the pigment for the black toner is carbon black, and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigments into said toner resin wherein a cyan, magenta and yellow pigment water wet cake is mixed with said toner resin and the water is removed to generate pigmented resin containing from about 25 to about 50 weight percent of pigment based on the weight percent of said toner resin and said pigment; and wherein each of the resulting pigmented resin concentrated products is mixed and diluted with additional toner resin to generate cyan, magenta and yellow toners containing each of said cyan, magenta or yellow pigments, respectively, in an amount of from about 2 to about 15 weight percent.

25. A process in accordance with claim 24 wherein there is enabled the formation of a full color gamut image, wherein the fused images obtained with said toner combination possess a Gardner Gloss value of from about 40 to 70 gloss units, wherein from about 70 to about 98 percent of the transmitted light passing through said fused images contained on a transparency reaches a projection screen from an overhead projector.

26. A xerographic imaging and printing apparatus comprised in operative relationship of an imaging member component, a charging component, four development components, a transfer component, and a fusing component, and wherein said development components include therein carrier and a combination of four color toners, and wherein the four toners are comprised of a cyan toner, a magenta toner, a yellow toner, and a black toner, respectively, each of said toners being comprised of resin and pigment, and wherein the pigment for the cyan toner is a β type copper phthalocyanine, the pigment for the magenta toner is a xanthene silicomolybdic acid salt of Rhodamine 6G dye, the pigment for the yellow toner is an isoindoline, and the pigment for the black toner is carbon black, and wherein said cyan toner is present in a first development component, said magenta toner is present in a second development component, said yellow toner is present in a third development component, and black toner is present in a fourth development component; and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigments into said toner resin wherein a cyan, magenta and yellow pigment water wet cake is mixed with said toner resin and the water is removed to generate pigmented resin containing from about 25 to about 50 weight percent of pigment based on the weight percent of said toner resin and said pigment; and wherein each of the resulting pigmented resin concentrated products is mixed and diluted with additional toner resin to generate cyan, magenta and yellow toners containing each of said cyan, magenta or yellow pigments, respectively, in an amount of from about 2 to about 20 weight percent.

27. An apparatus in accordance with claim 26 wherein said development components are comprised of four separated housings and wherein one housing contains the cyan toner, the second housing contains a magenta toner, the third housing contains the yellow toner, and the fourth housing contains the black toner, each of said toners consisting essentially of resin and pigment, and wherein said cyan pigment is Pigment Blue 15:3 having a Color Index Constitution Number of 74160, said magenta pigment is Pigment Red 81:3 having a Color Index Constitution Number of 73915, and said yellow pigment is Pigment Yellow 185 having a Color Index Constitution Number of 56290.

28. A combination of four color toners consisting essentially of a cyan toner, a magenta toner, a yellow toner, and a black toner, each of said toners being consisting essentially of resin and pigment, and wherein the pigment for the cyan toner is β type copper phthalocyanine, the pigment for the magenta toner is a xanthene silicomolybdic acid salt of Rhodamine 6G dye, the pigment for the yellow toner is an isoindoline, and the pigment for the black toner is carbon black, and wherein each of said magenta, yellow and cyan pigment is of a particle diameter size of from about 0.01 micron to about 0.3 micron, and said black pigment is of a particle diameter size of from about 0.001 micron to about 0.1 micron, and wherein each of said cyan, magenta and yellow pigment is dispersed in said toner resin by flushing said cyan, magenta and yellow pigments into said toner resin wherein a cyan, magenta and yellow pigment water wet cake is mixed with said toner resin and the water is removed to generate pigmented resin containing from about 25 to about 50 weight percent of pigment based on the weight percent of said toner resin and said pigment; and wherein said cyan, said magenta and said yellow pigments are flushed into the toner resin by the mixing thereof with said toner resin and heating at a temperature of from about 50° to about 125° C. to remove water thereby enabling a pigment concentration for said magenta, said cyan, and said yellow pigment of about 50 weight percent, and thereafter diluting by adding thereto further toner resin and wherein the amount of pigment present is reduced to about 2 to about 20 weight percent.

29. A toner in accordance with claim 1 wherein each of said four toners exists as a separate composition and is unmixed.

* * * * *